United States Patent [19]

Martens

[11] 3,989,431

[45] Nov. 2, 1976

[54] PILE EXTRUDER

[75] Inventor: Ernst Martens, Winnipeg, Canada

[73] Assignee: Spirill Corporation Ltd., Winnipeg, Canada

[22] Filed: Feb. 10, 1975

[21] Appl. No.: 548,272

[30] Foreign Application Priority Data

Feb. 11, 1974 United Kingdom ..... 6099/74

[52] U.S. Cl. ..... 425/112; 72/138; 264/35; 425/114; 425/376; 425/449

[51] Int. Cl.[2] ..... B28B 3/22

[58] Field of Search ..... 72/135, 138; 264/33, 264/34, 35; 425/63, 64, 65, 113, 114, 112, 129, 219, 432, 456, 376, 380, 449

[56] References Cited

UNITED STATES PATENTS

| | | | |
|---|---|---|---|
| 1,538,425 | 5/1925 | Debay | 425/219 X |
| 3,375,550 | 4/1968 | Klein | 425/114 |
| 3,497,579 | 2/1970 | Barron | 425/63 X |
| 3,526,692 | 9/1970 | Onaka | 425/113 X |
| 3,605,217 | 9/1971 | Martens et al. | 425/114 |
| 3,877,860 | 4/1975 | Putti | 425/432 X |

*Primary Examiner*—Francis S. Husar
*Assistant Examiner*—Mark Rosenbaum
*Attorney, Agent, or Firm*—Stanley G. Ade

[57] ABSTRACT

A pile extruder machine includes a hopper and a head or mandrel assembly extending from a support, into a moulding chamber assembly. Feed augers are provided on each side of the head or mandrel and these feed augers compress concrete from the hopper into the moulding chamber around the head or mandrel thus forming the pile and the compression moves the machine forwardly so that the pile is extruded rearwardly upon a pallet. A die assembly forms links of coil reinforcing around a coil support tube and the die assembly can be adjusted so that both the pitch and diameter of the lengths of coil can be adjusted. These coils are fed into the concrete mass at the base of the hopper and surround longitudinally extending reinforcing wires. They are drawn into the pile as it is formed and thus reinforce the piles circumferentially around the central aperture formed therein thus giving longitudinal and circumferential reinforcing to the finished pile.

21 Claims, 10 Drawing Figures

PILE EXTRUDER

BACKGROUND OF THE INVENTION

Conventional type pile extruders are enabled to incorporate longitudinally extending reinforcing cables by extruding the pile over the cables. However, it is difficult to introduce spiral coils into the piles which is a desirable way of reinforcing same. The present invention overcomes this disadvantage by providing a device which can introduce coils of wire into the pile during the extrusion process and may also provide adjustable side and top plate assemblies forming the packing chamber, said assemblies being either driven or stationary.

SUMMARY OF THE INVENTION

The principal object and essence of the invention is therefore to provide a device which forms lengths of coils and enables them to be fed into the pile during the extrusion process.

Another object of the invention is to provide a device of the character herewithin described in which the pitch can be varied of various sections of the coils incorporated in one pile.

Another object of the invention is to provide a device of the character herewithin described in which the wire bending device can be adjusted so that the diameter and pitch of the coils being formed thereby, can be varied.

Another object of the invention is to provide a device of the character herewithin described which may include novel side and top belt plate assemblies constituting the sides and top of the packing or moulding chamber.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

DESCRIPTION OF THE DRAWINGS

In the drawings like characters of reference indicate corresponding parts in the different figures.

DETAILED DESCRIPTION

Figure 1:
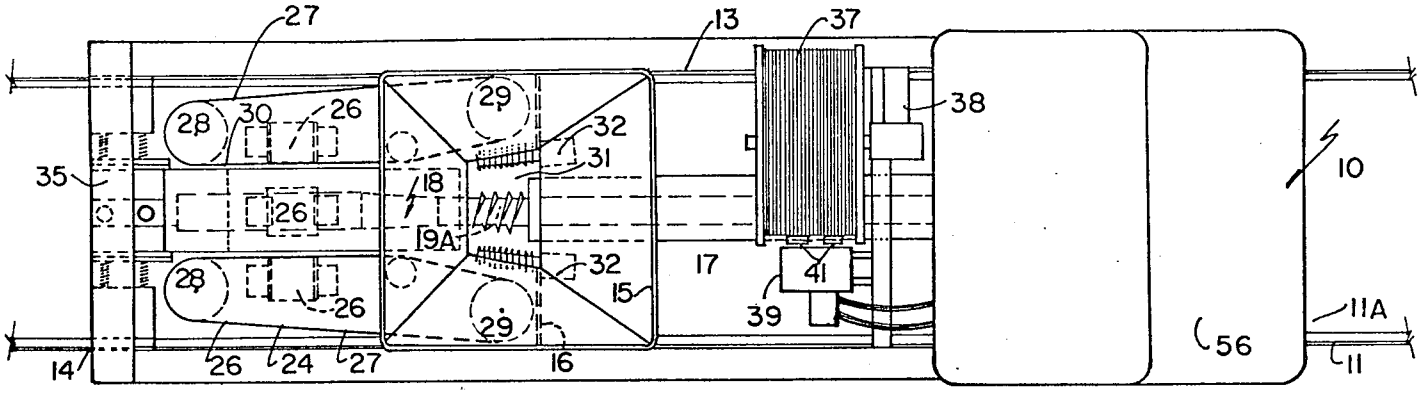
FIG. 1 is a top plan view of the device.

Proceeding therefore to describe the invention in detail, reference should first be made to FIGS. 1 to 5 inclusive.

The machine collectively designated 10 is adapted to run on rails 11 between which is situated a flat bed constituting the pallet 11A upon which the pile collectively designated 12 is formed. A supporting framework 13 includes wheels 14 engaging the rails 11 as clearly shown in FIGS. 1 and 2.

A hopper 15 is situated above the framework 13 and supported thereby and includes a back plate 16 which extends downwardly upon each side of a coil guide tube 17. This coil guide tube terminates just rearwardly of the back plate 16 and supports a head or mandrel assembly collectively designated 18 and which extends rearwardly. It consists of a tubing portion 19, the diameter of which increases within a short tapered portion 20 and which then extends rearwardly and terminates in a cylindrical parallel portion 21 and this head forms the aperture 22 running through the centre of the finished pile 12.

Although this aperture is shown as being circular in cross section, nevertheless it will be appreciated that it can be formed in any cross sectional configuration desired merely by changing the shape of the distal end 23 of the head.

Vibrators (not illustrated) are built into the assembly 18 to assist in the compaction and flow of concrete as the pile is being formed.

The head 18 extends through the packing chamber, the base of which is of course the pallet situated between rails 11.

Figure 2:
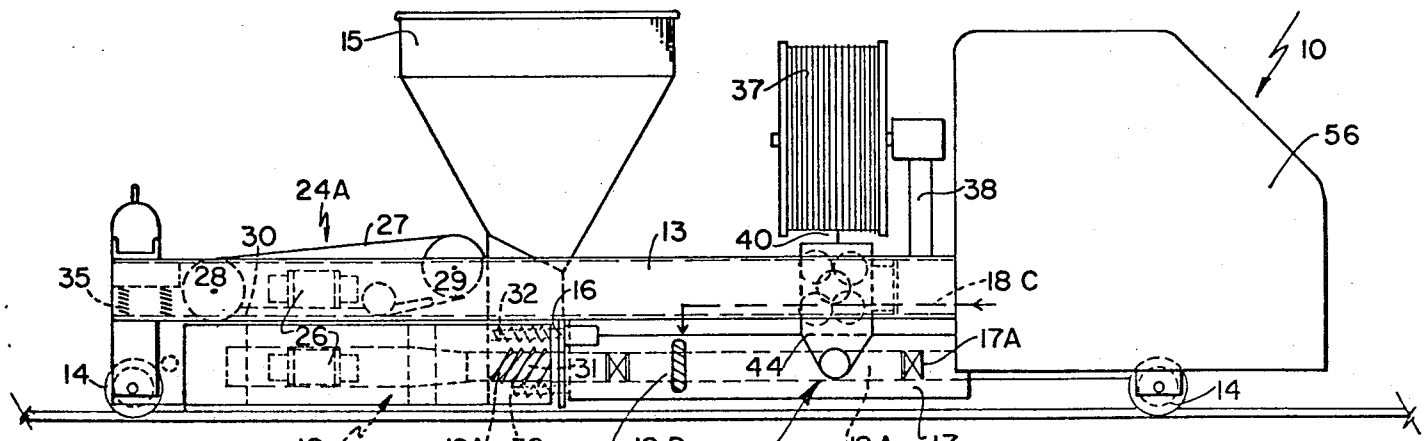
FIG. 2 is a side elevation thereof.
Figure 3:
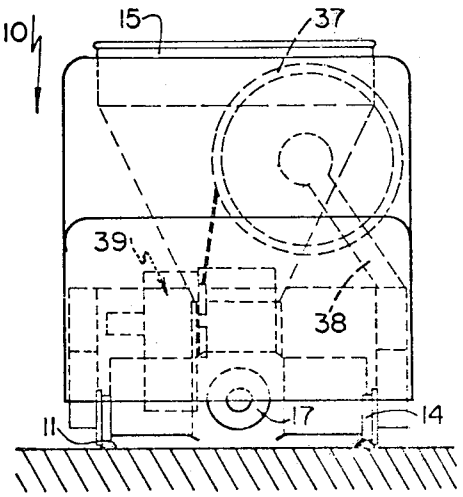
FIG. 3 is a rear view thereof.

The two sides and top of the packing chamber are formed by side plate assemblies collectively designated 24, there being two such side plate assemblies, one upon each side of the device and one top side plate assembly specifically designated 24A and shown in FIG. 2.

All of the side plate assemblies are similar in construction and in this embodiment, include a stationary side plate 25 having a vibrator assembly 26 operatively secured thereto. An endless belt 27 extends around a rear pulley 28 and a front pulley 29 with the inner run 30 of the belt running over the inner side of the side plate 25 as clearly shown in FIG. 4. The belt is driven by attaching a source of power to one of the pulleys 28 or 29. A forward adjustable portion 25A of the side plates is provided pivoting upon pivot 26' and diverge outwardly thus forming a feeding throat area 31 immediately below the discharge of the hopper 15. Relatively short feed auger assemblies 32 driven by hydraulic motors 32A, or the like, are provided upon each side of the tube 17 are are mounted on the back plate 16 of the hopper. The augers extend rearwardly from the back plate 16 of the hopper and assist in feeding the concrete into the feed throat 31 whereupon it is compacted by the side plate assemblies 24 and the pallet into the shape of the finished pile illustrated in FIG. 5. The compaction of the concrete causes the machine to move forwardly so that the pile is extruded therebehind upon the pallet between the rails 11.

Figure 5:
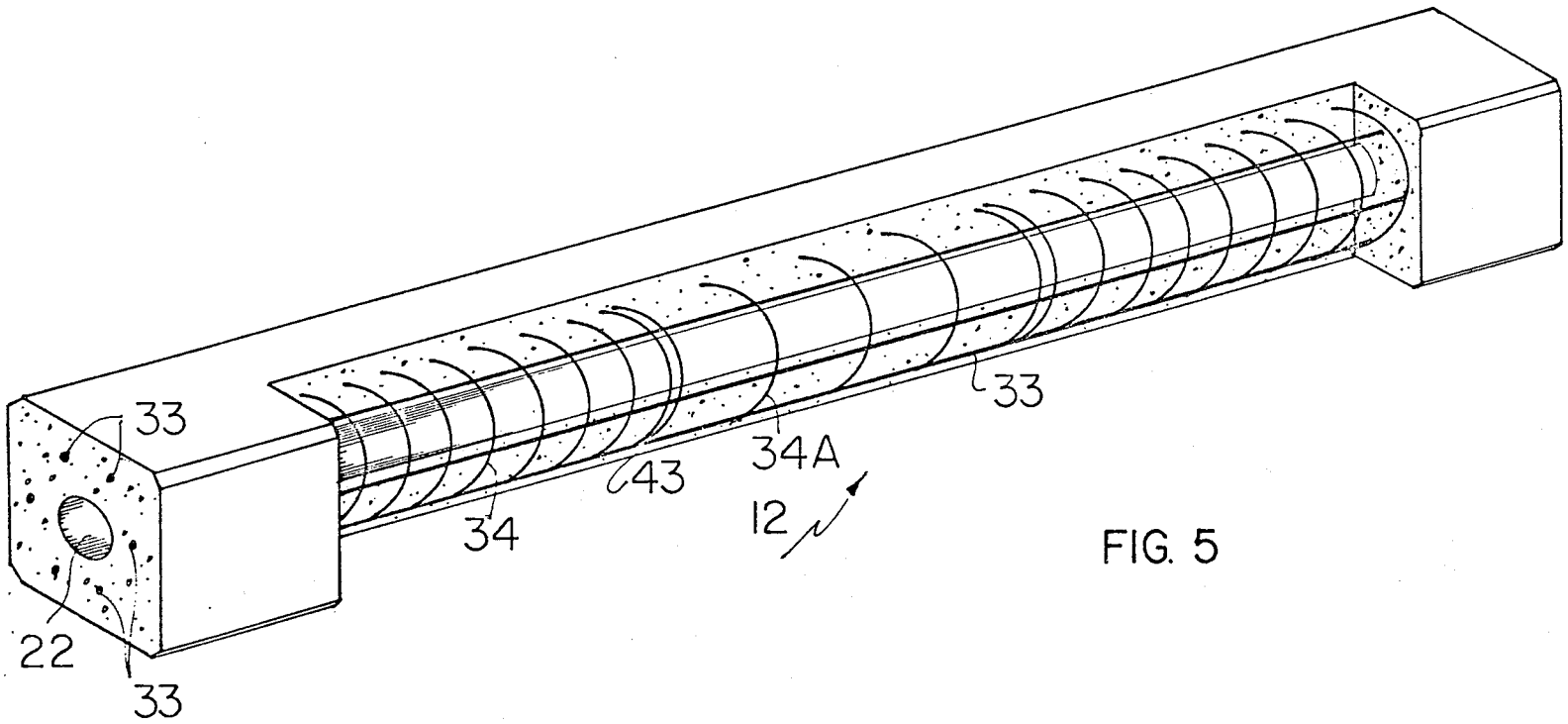
FIG. 5 is an isometric partially cut away view of a pile formed by the device.
Figure 6:
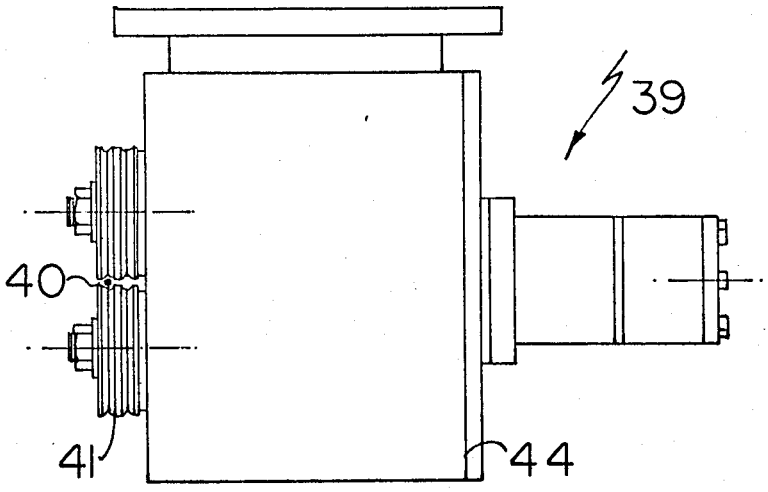
FIG. 6 is a top plan view of the coil forming device per se.
Figure 7:
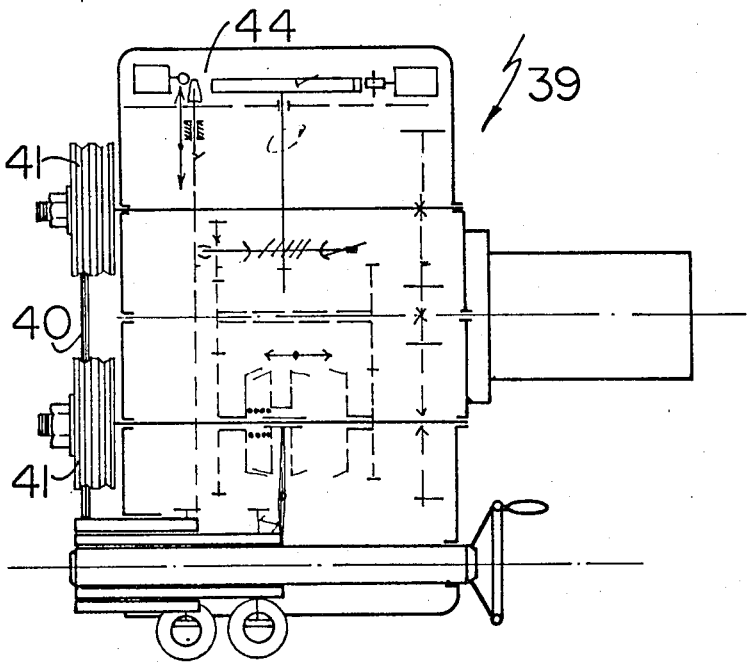
FIG. 7 is a side elevation of FIG. 6.

Prior to forming the pile, a plurality of longitudinally extending pre-stressed reinforcing cables 33 are extended end to end upon the pallet and supported thereabove so that the pile is extruded around these cables 33 (see FIG. 5). It is desirable to further reinforce the pile by the provision of lengths of coils of wire 34, 34A, etc., which, in the finished pile, extend around the longitudinally extending reinforcing cables 33 and in this regard it should be observed that these cables 33 extend through the tube 17 which is split longitudinally top and bottom and mounted on a hinge so that the tube or die can be opened. However, this construction is not shown in the attached drawings.

Travelling plates 35, are situated rearwardly of the packing chamber and are spring loaded by means of springs 36 and are provided in order to smooth the sides and top of the pile as it is formed and as this portion of the machine passes along the extruded pile 12.

It should also be noted that the angle of inclination of the side portions 25A is adjustable although the means for adjusting these is not shown on the attached drawings inasmuch as any convenient form of adjustment can be provided.

Means are provided to form the coils 34, 34A and take the form of a coil of wire 37 mounted upon the framework forwardly of the hopper 15 and upon standard 38. A coil forming assembly collectively designated 39 is mounted below the coil 37 and receives the strand of wire 40 coming from the feed coil 37 and in this regard, reference should be made to FIGS. 6 to 9. The strand of wire extends between two pairs of drive rollers or sheaves 41 extending from the coil forming device 39 and being supported thereby. This strand 40 is driven through a die assembly collectively designated 42 and shown in FIG. 9, which causes it to form a coil around the coil guide tube 17, the pitch and diameter of the coils being formed, being controlled by the die 42.

Figure 4:
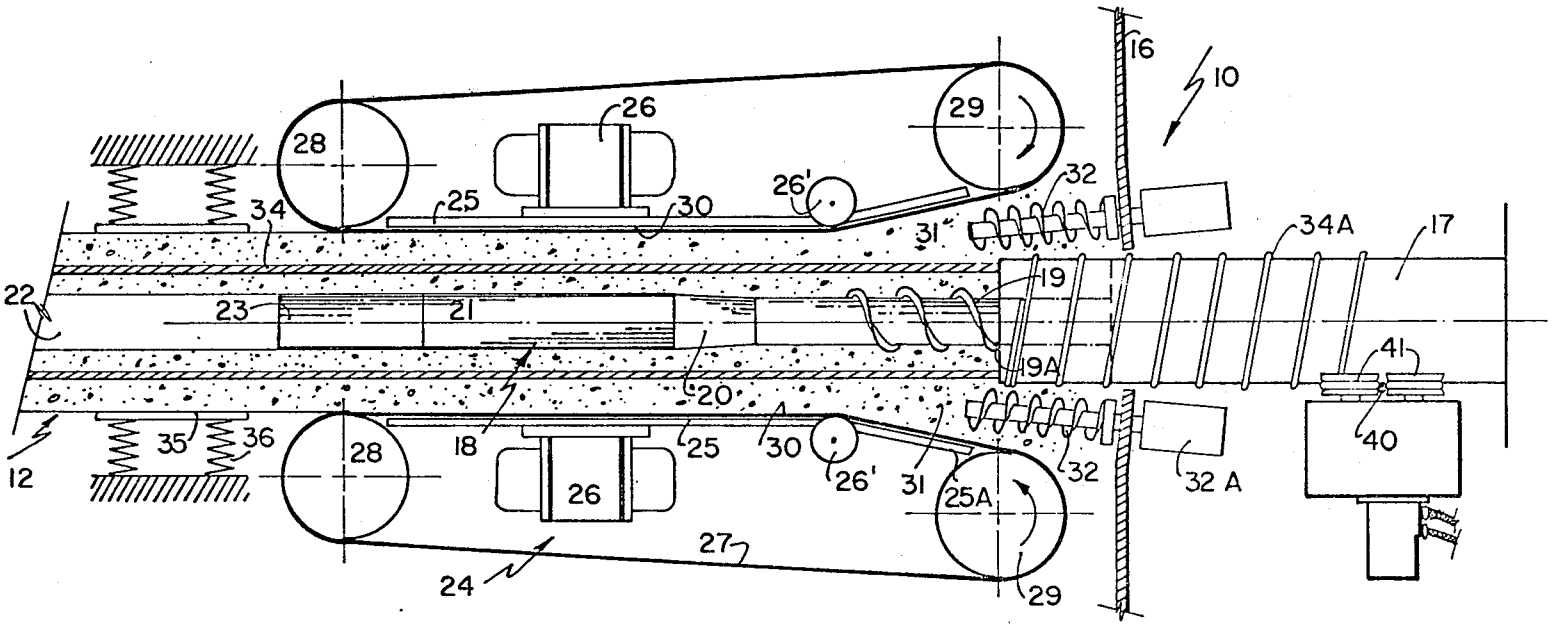
FIG. 4 is an enlarged top plan view with top plate assembly and hopper removed for clarity.

As the coil is formed around the guide tube 17, it is rotated around the guide tube by the coil forming action and feeds rearwardly to the end of the guide tube whereupon the first coil is pushed by hand underneath the hopper into the concrete so that the coil is then cut off and drawn off by this concrete and engages around the longitudinally extending wire strands or cables 33 as clearly shown in FIGS. 4 and 5 it being understood that as soon as one end is embedded into the concrete mass, the coil cannot continue to rotate on the guide tube.

Under certain circumstances, it is desirable that the coil reinforcing at the ends of the pile have a pitch closer together than the coils of the center portion therebetween so that the individual sections can be made by the die 42 and interlock one with the other by overlapping the coils at the adjacent ends of the sections as shown by reference character 43 in FIG. 5. This means that once the first coil of the first section is embedded manually within the concrete mass at the base of the hopper, all of the coil reinforcing sections are pulled from the coil guide tube as the pile and the coil reinforcing sections are being formed.

Figure 9:
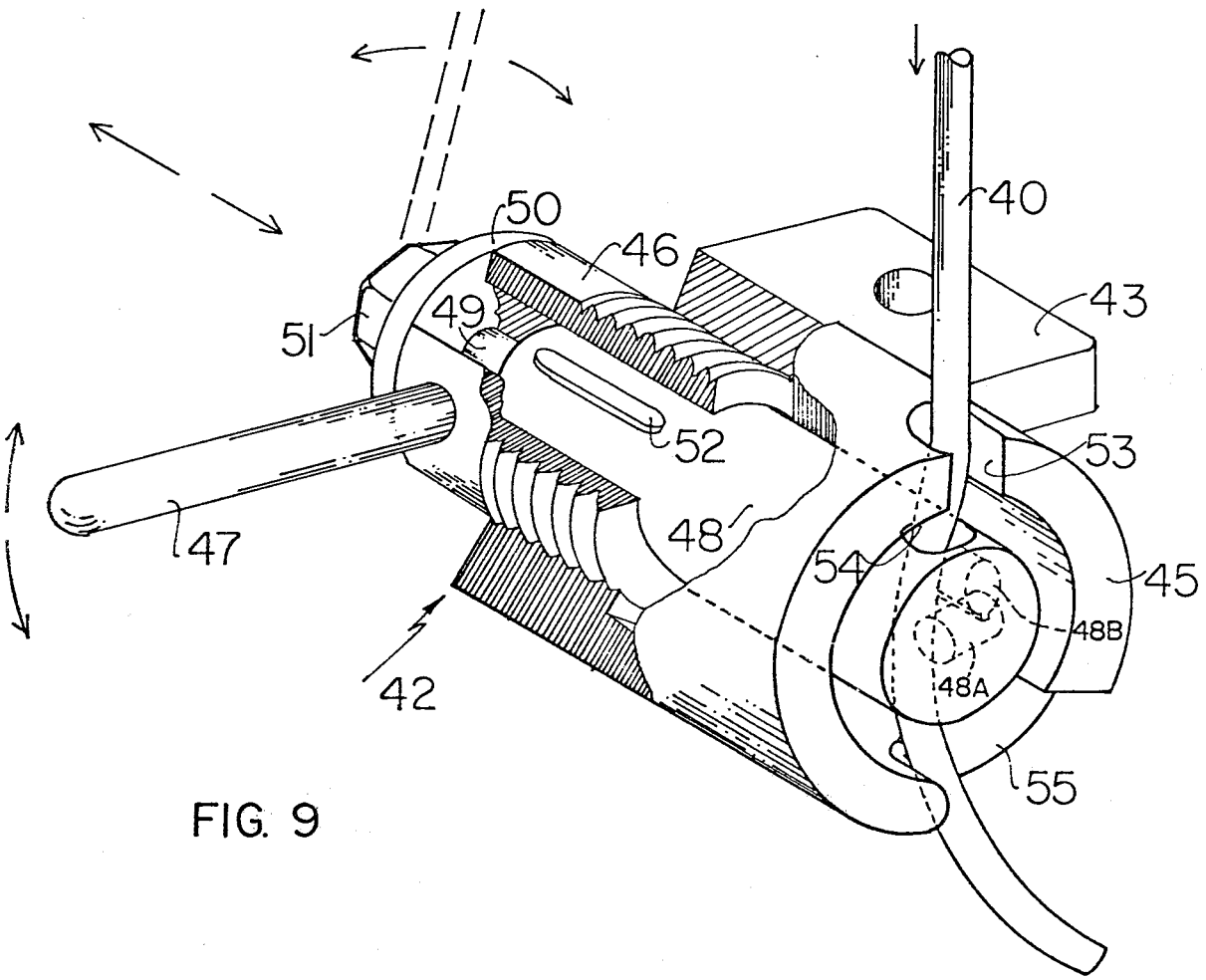
FIG. 9 is an enlarged isometric view of the coil adjustment device per se.

The die 42 is shown in detail in FIG. 9 and consists of a body portion 43 by which the device may be secured to the casing 44 of the coil forming assembly 39. The die assembly includes the cylindrical shell 45 of the casing within which a die shell 46 is screw threadably engageable and adjustable radially with relation to the shell 45, by means of lever 47.

Within the die shell 46, is a die cylinder 48 which includes a rear screw threaded extension 49 extending through the end plate 50 of the shell 46 and having nut 51 screw threadably engageable upon the end thereof.

This die is keyed within the shell 46 by means of key 52 so that it cannot rotate independently of shell 46, but can be moved endwise by adjusting nut 51.

The strand of wire 40 extends downwardly through cut out portion 53 within the outer shell 45, through a die aperture 54 within the front end of the die cylinder 48 and through a further cut out portion 55 within the outer shell 45, all of which are shown clearly in FIG. 9. By moving the inner cylinder 48 inwardly or outwardly relative to the shell 45, the diameter of the coils formed thereby are controlled within limits and by rotating the die shell 46 slightly by means of lever 47, the pitch between individual coils is controlled within limits. Cylindrical guides 48A and 48B are provided within the die aperture and guide the wire strand therethrough.

A wire cut off device (not illustrated) is provided which can be actuated at the end of the forming of each section of reinforcing wire coil.

The die assembly 42 causes the wire 40 to form the coil around the coil guide tube with the pitch and diameter desired and by adjusting the die assembly 42, this pitch can be varied as desired, to form the individual reinforcing coil sections 34, 34A, etc.

One of the main advantages of the assembly illustrated for forming piles is the fact that the mandrel or head assembly 18 is stationary and is provided with a vibrator. This, together with the hammering plates or side plates 25, form the pile with the elimination of torque and concrete flows which are provided when a rotary type auger assembly is used for the formation of concrete piles.

However, if desired, the mandrel or head assembly can be rotated slowly in either direction desired by mounting the supporting shaft 18A within bearings 17A contained within the coil guide tube 17. A sprocket 18B may be secured to this supporting shaft 18A and may be connected to the source of power as indicated by dotted line 18C.

Under these circumstances, and depending upon design perameters, a relatively short length of auger flighting 19A may be secured around the portion of the tubing 19 just rearwardly of the rear end of the coil guide tube and this in conjunction with the feed augers 32, can assist in the initial feeding of the concrete from the hopper into the packing chamber.

It will of course be appreciated that if the auger flighting 19A is provided then the mandrel head assembly should rotate in the desired direction so that concrete is fed rearwardly by the auger flights 19A. Furthermore slow rotation of this head or mandrel will give a smoother finish to the bore 22 formed in the pile 12.

Another advantage of being able to rotate the core mandrel 18 whether or not the auger flights 19A are provided, is that it prevents any possibility of dead spots occurring by the action of the vibrator 26 within the mandrel or head.

Figure 10:
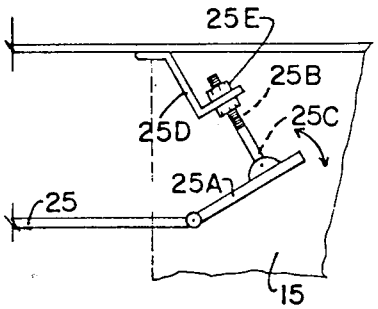
FIG. 10 is a fragmentary top plan view of an alternative construction of one of the side plates.
Figure 8:
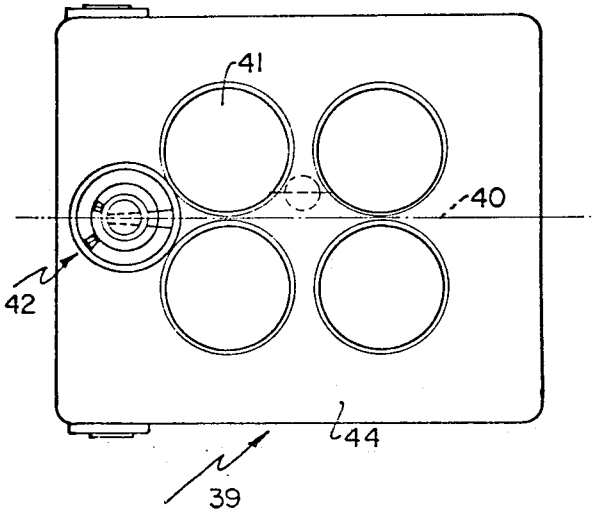
FIG. 8 is a front elevation of FIG. 6.

Reference should also be made to FIG. 10 which shows schematically, an alternative embodiment for the construction of the side plate assemblies 24. Under certain circumstances it may not be necessary or desirable to drive these side plate or top plate assemblies. Under these conditions the stationary side plate 25 and the movable side plate portion 25A are extended to form the entire side plate assemblies of the moulding chamber. Adjustment means such as that illustrated by 25B may be provided between the movable portion 25A and the side casing and in this embodiment, this adjustment takes the form of a screw threaded rod 25C held within a bracket 25D and adjusted by means of nuts 25E engaging the rod on either side of the bracket. A similar construction may of course be used for the top plate assembly 24A.

Means are provided (not illustrated) so that the extruder machine 10 can be interlocked with the pallet and rails so that the compaction can be controlled and uplift of the extruder is eliminated.

The source of power for the operation of the various components is contained within the casing 56 at the front of the machine.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention:

1. A pile extruding machine which is adapted to be mounted for movement along a pair of rails having a pallet therebetween, a plurality of longitudinally extending reinforcing wires supported above said pallet for incorporation into the pile formed by said machine, a source of power and a source of reinforcing wire mounted on said machine; said machine comprising in combination supporting framework, a feed hopper supported by said framework, a packing chamber extending rearwardly of and below said hopper, said hopper communicating with said packing chamber, means adjacent said packing chamber to feed concrete from said hopper into said packing chamber, a mandrel assembly mounted by one end thereof to said framework and extending rearwardly under the base of said hopper and through said packing chamber substantially concentrically therewith, non rotatable coil guide means extending forwardly of the base of said hopper and concentric with said mandrel assembly, a coil forming assembly mounted on said framework and connected to said source of power to form individual lengths of coils of reinforcing wire in a rotatable manner around said coil guide means said individual length of coils being interlocked one with the other by adjacent ends thereof.

2. The invention according to claim 1 which includes means on said coil forming assembly to adjust the pitch of said lengths of coils of reinforcing wire and further means on said coil forming assembly to adjust the diameter of the coils of said lengths of coils of said reinforcing wire.

3. The invention according to claim 1 in which said coil forming assembly includes a casing secured to said supporting framework an open ended cylindrical shell forming part of said casing, upper and lower cut out guide portions on one end of said shell, and a die cylinder mounted in said shell, said die cylinder including a die aperature through said die cylinder, said reinforcing wire extending through said upper cut out guide portion, through said die aperature in said die cylinder and through said lower cut out guide portion in said shell, and means to drive said reinforcing wire through said coil forming assembly.

4. The machine according to claim 2 in which said coil forming assembly includes a casing on said supporting framework, an open ended cylindrical shell forming part of said casing, upper and lower cut out guide portions on one end of said cylindrical shell, a die shell screw threadably engageable within said cylindrical shell for radially adjustment therewith and constituting said means to adjust the diameter of the coils of said lengths of coils of reinforcing wire, a die cylinder mounted for nonrotative adjustable endwise movement within said die shell and constituting said means to adjust the pitch of said lengths of coils of reinforcing wire said die cylinder including a die aperature through said die cylinder, said reinforcing wire extending through said upper cut out guide portion, through said die aperature in said die cylinder and through said lower cut out guide portion in said shell and means to drive said reinforcing wire through said coil forming assembly.

5. The invention according to claim 1 which includes a pair of side plate assemblies in spaced apart relationship and an upper plate assembly spanning the upper sides of said side plate assemblies, said side plate assemblies and said upper plate assembly, in conjunction with said associated pallet, defining said packing chamber.

6. The invention according to claim 2 which includes a pair of side plate assemblies in spaced apart relationship and an upper plate assembly spanning the upper sides of said side plate assemblies, said side plate assemblies and said upper plate assembly, in conjunction with said associated pallet, defining said packing chamber.

7. The invention according to claim 3 which includes a pair of side plate assemblies in spaced apart relationship and an upper plate assembly spanning the upper sides of said side plate assemblies, said side plate assemblies and said upper plate assembly, in conjunction with said associated pallet, defining said packing chamber.

8. The invention according to claim 4 which includes a pair of side plate assemblies in spaced apart relationship and an upper plate assembly spanning the upper sides of said side plate assemblies, said side plate assemblies and said upper plate assembly, in conjunction with said associated pallet, defining said packing chamber.

9. The assembly according to claim 5 in which said side plate assembly and said top plate assembly each includes a stationary side plate substantially parallel to the longitudinal axis of said mandrel assembly, a forward adjusting portion pivoted by one end thereof to one end of said side plate, and means to adjust the angle of said adjustable portion relative to said side plate.

10. The invention according to claim 9 which includes front and rear pulleys adjacent the ends of said side plate assembly and the ends of said top plate assembly, and an endless belt extending around said pulleys and along the surface of said stationary side plates and said forward adjusting portions thereof, and means to drive said belt.

11. The invention according to claim 1 in which said means to feed concrete from said hopper into said packing chamber includes a pair of feed augers mounted in the base of said hopper and inclining inwardly and rearwardly across said base one upon each side of said mandrel assembly, and means for driving said feed augers.

12. The invention according to claim 4 in which said means to feed concrete from said hopper into said packing chamber includes a pair of feed augers mounted in the base of said hopper and inclining inwardly and rearwardly across said base one upon each side of said mandrel assembly, and means for driving said feed augers.

13. The invention according to claim 5 in which said means to feed concrete from said hopper into said packing chamber includes a pair of feed augers mounted in the base of said hopper and inclining inwardly and rearwardly across said base one upon each side of said mandrel assembly, and means for driving said feed augers.

14. The invention according to claim 9 in which said means to feed concrete from said hopper into said packing chamber includes a pair of feed augers mounted in the base of said hopper and inclining inwardly and rearwardly across said base one upon each side of said mandrel assembly, and means for driving said feed augers.

15. The invention according to claim 11 which includes means to mount said mandrel assembly by one end thereof for rotation within said coil guide means and a feed auger flight secured to the portion of said mandrel assembly immediately below the base of said hopper.

16. The invention according to claim 12 which includes means to mount said mandrel assembly by one end thereof for rotation within said coil guide means and a feed auger flight secured to the portion of said mandrel assembly immediately below the base of said hopper.

17. The invention according to claim 13 which includes means to mount said mandrel assembly by one end thereof for rotation within said coil guide means and a feed auger flight secured to the portion of said mandrel assembly immediately below the base of said hopper.

18. The invention according to claim 14 which includes means to mount said mandrel assembly by one end thereof for rotation within said coil guide means and a feed auger flight secured to the portion of said mandrel assembly immediately below the base of said hopper.

19. A coil forming assembly for use with pile extruding machines and the like which include a source of power, coil guide means on said machine and a source of reinforcing wire for said coil forming assembly; said coil forming assembly comprising in combination a casing, an open ended cylindrical shell forming part of said casing, upper and lower cut out guide portions on one end of said shell, and a die cylinder mounted in said shell, said die cylinder including a die aperature through said die cylinder, said reinforcing wire extending through said upper cut out guide portion, through said die aperture in said die cylinder and through said lower cut out guide portion in said shell and means to drive said reinforcing wire through said coil forming assembly.

20. The coil forming assembly according to claim 19 which includes means on said coil forming assembly to adjust the pitch of said length of coils of reinforcing wire and further means on said coil forming assembly to adjust the diameter of the coils of said lengths of coils of reinforcing wire.

21. The coil forming assembly according to claim 20 which includes a die shell, screw threadably engageable within said cylindrical shell for radial adjustment therewith and constituting said means to adjust the diameter of the coils of said lengths of coils of reinforcing wire, said die cylinder being mounted for nonrotative endwise movement within said die shell and constituting said means for adjusting the pitch of said lengths of coils of reinforcing wire.

* * * * *